US006746170B2

(12) United States Patent
Delage

(10) Patent No.: US 6,746,170 B2
(45) Date of Patent: Jun. 8, 2004

(54) DEVICE FOR PACKAGING AND DISTRIBUTING A SUBSTANCE

(75) Inventor: Jean-François Delage, Clamart (FR)

(73) Assignee: L'Oreal, Paris (FR)

( * ) Notice: Subject to any disclaimer, the term of this patent is extended or adjusted under 35 U.S.C. 154(b) by 0 days.

(21) Appl. No.: 10/187,636

(22) Filed: Jul. 3, 2002

(65) Prior Publication Data

US 2003/0057236 A1 Mar. 27, 2003

(30) Foreign Application Priority Data

Jul. 3, 2001 (FR) ..... 01 08804

(51) Int. Cl.[7] ..... B05C 11/00; B43K 1/06

(52) U.S. Cl. ..... 401/266; 401/265; 401/172; 401/171

(58) Field of Search ..... 401/266, 172, 401/174, 86, 68, 75

(56) References Cited

U.S. PATENT DOCUMENTS 4,298,036 A * 11/1981 Horvath ..... 141/1
5,879,095 A 3/1999 Gueret
6,210,061 B1 * 4/2001 Johnson ..... 401/175
6,398,439 B1 * 6/2002 Szekely ..... 401/79

FOREIGN PATENT DOCUMENTS

EP 0709041 5/1996

OTHER PUBLICATIONS

Gueret (U.S. Patent Application Publication No. 2001/0003564) dated Jun. 14, 2001.

* cited by examiner

*Primary Examiner*—David Walczak
(74) *Attorney, Agent, or Firm*—Oblon, Spivak, McClelland, Maier & Neustadt, P.C.

(57) ABSTRACT

A device for packaging and distributing a substance, for example, a liquid. The device includes a housing for the substance, a piston movable in the housing, and a piston-driving mechanism. The piston-driving mechanism includes a first element turnable relative to a second element to cause axial displacement of the piston in the housing, after at least one of the elements has turned an amount relative to the other. The device can include a ring for transforming relative rotation of the two elements over a first angular path in a substance-dispensing direction into relative axial displacement of the two elements. The ring can be arranged to turn firstly with the first element over the first angular path and to co-operate with the second element to cause the axial displacement. Secondly, the ring can turn when relative rotation of the two elements is continued beyond the first angular path, relative to the sleeve element by being driven in rotation by the second element.

61 Claims, 5 Drawing Sheets

Fig. 1
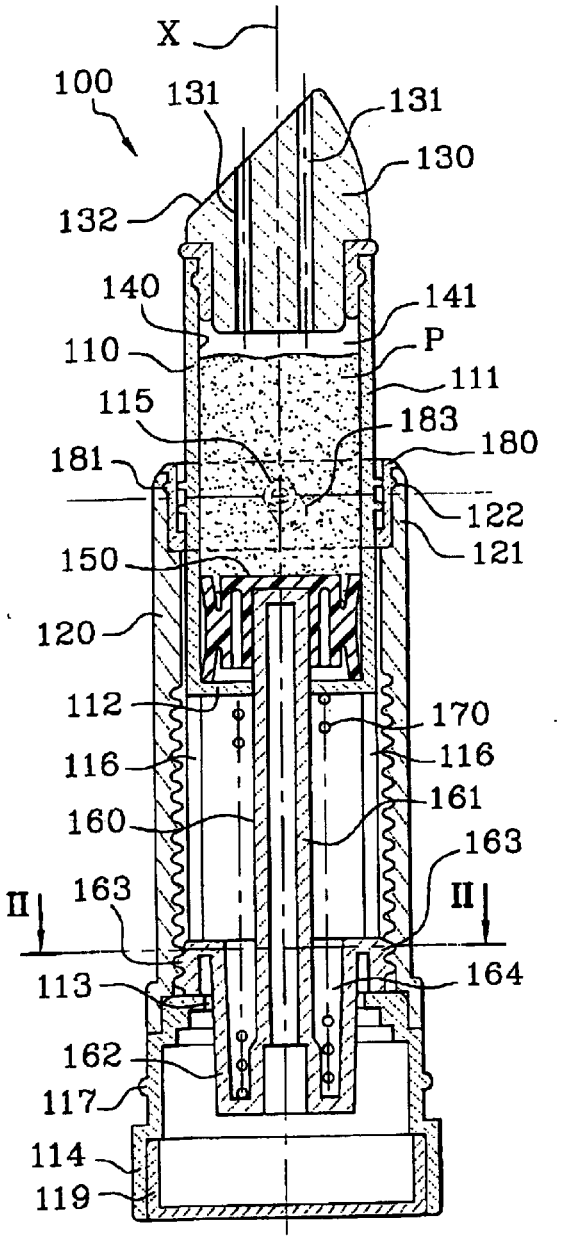
Fig. 3
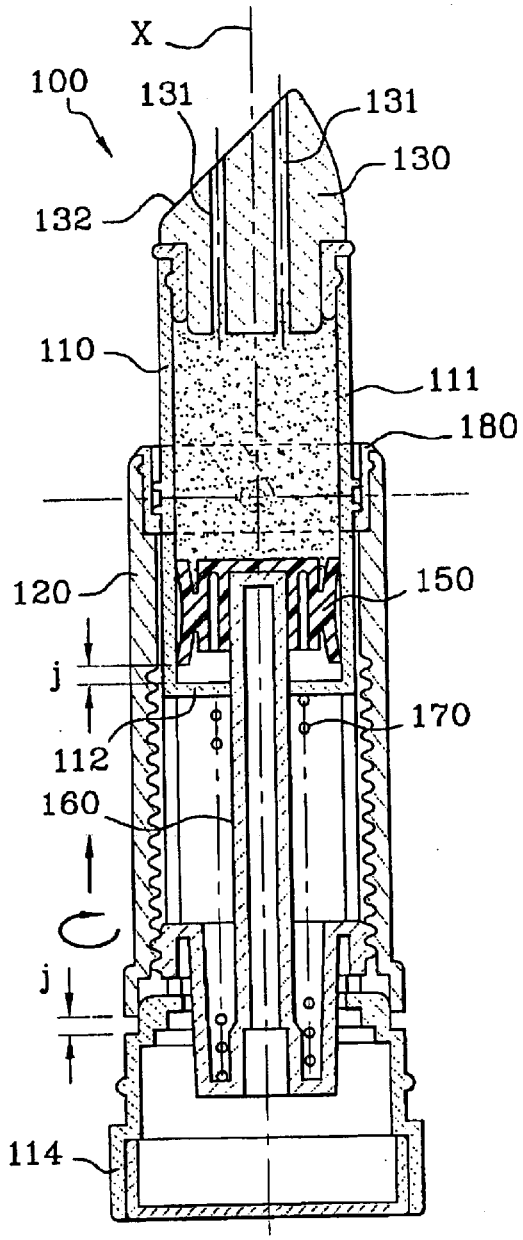
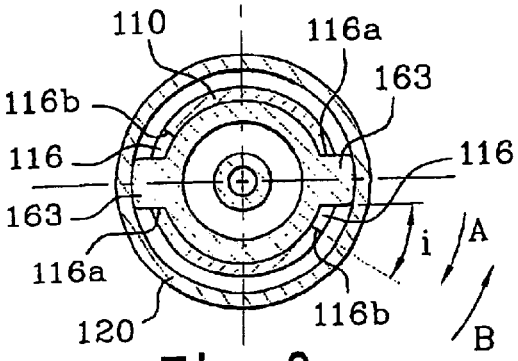
Fig. 2
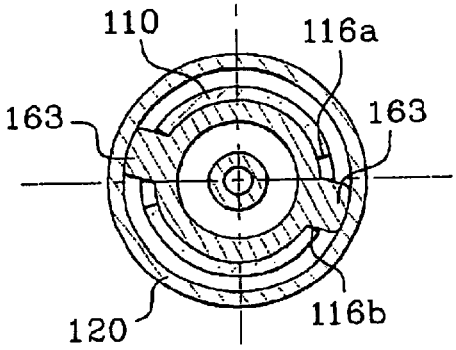
Fig. 4

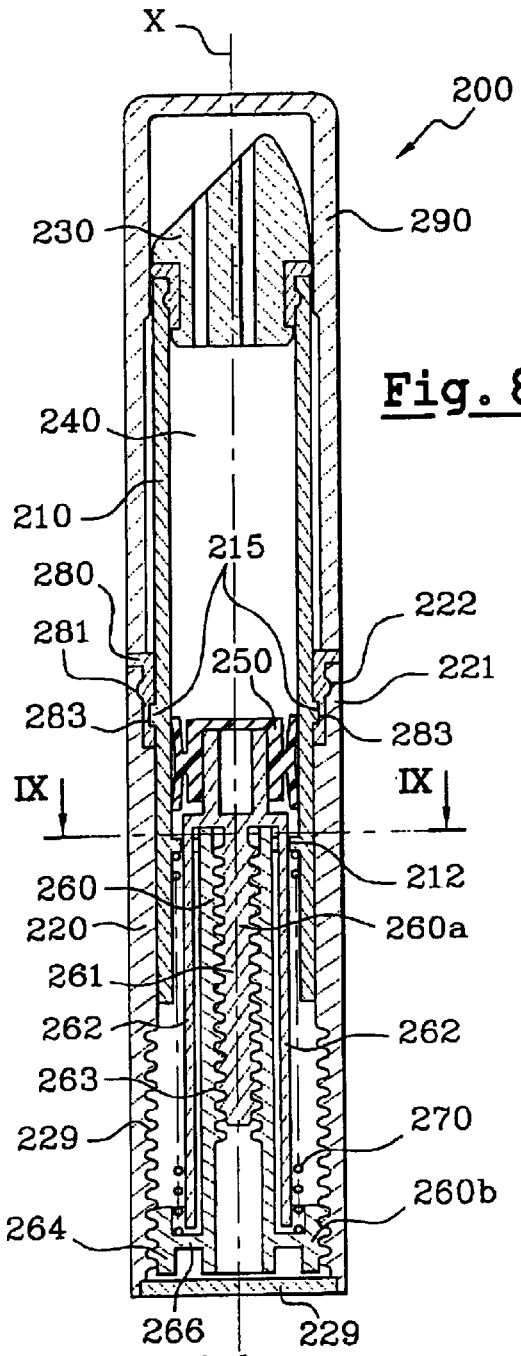
Fig. 8
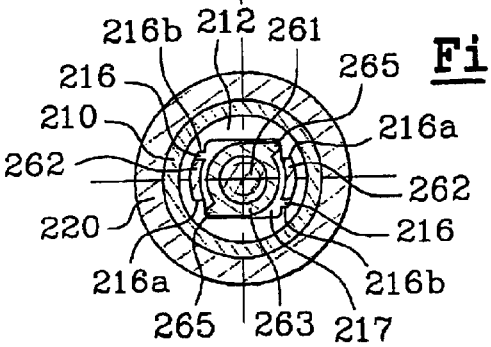
Fig. 9
Fig. 10
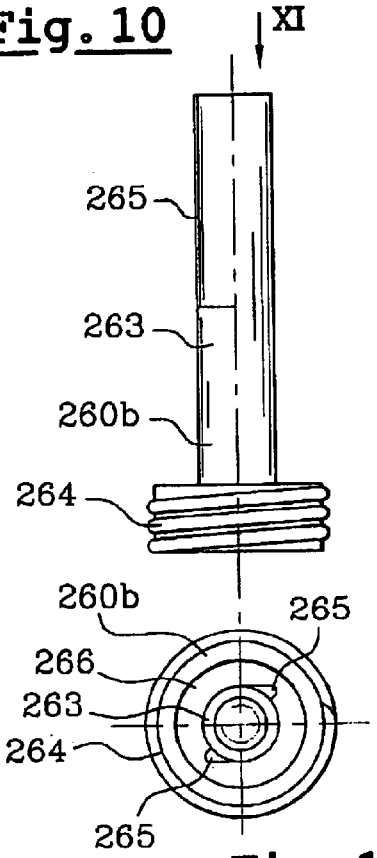
Fig. 11
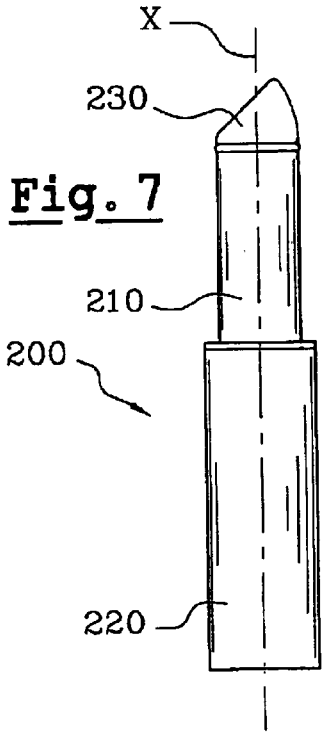
Fig. 7

Fig. 12
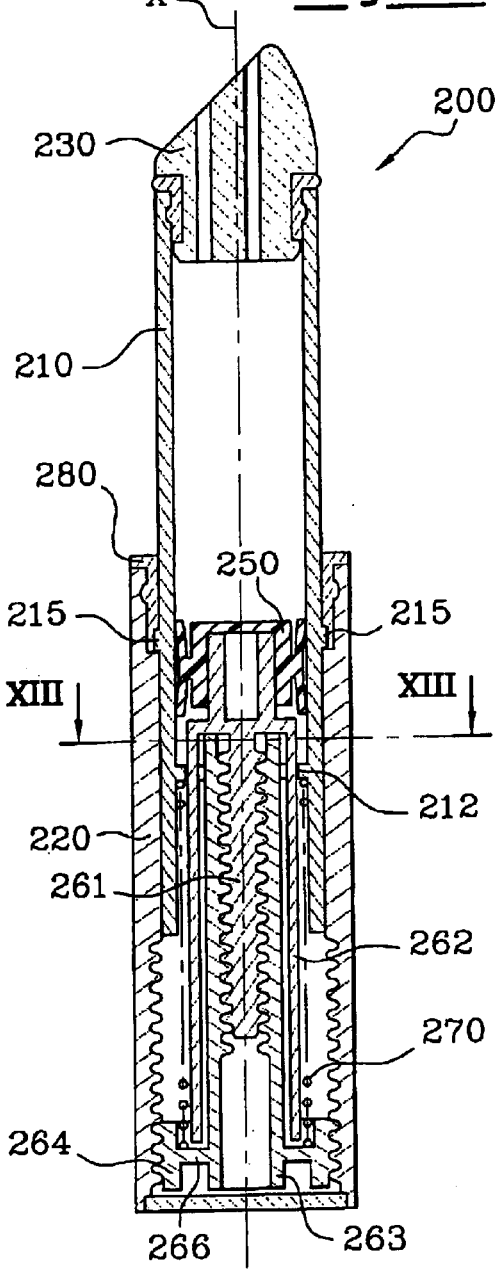
Fig. 14
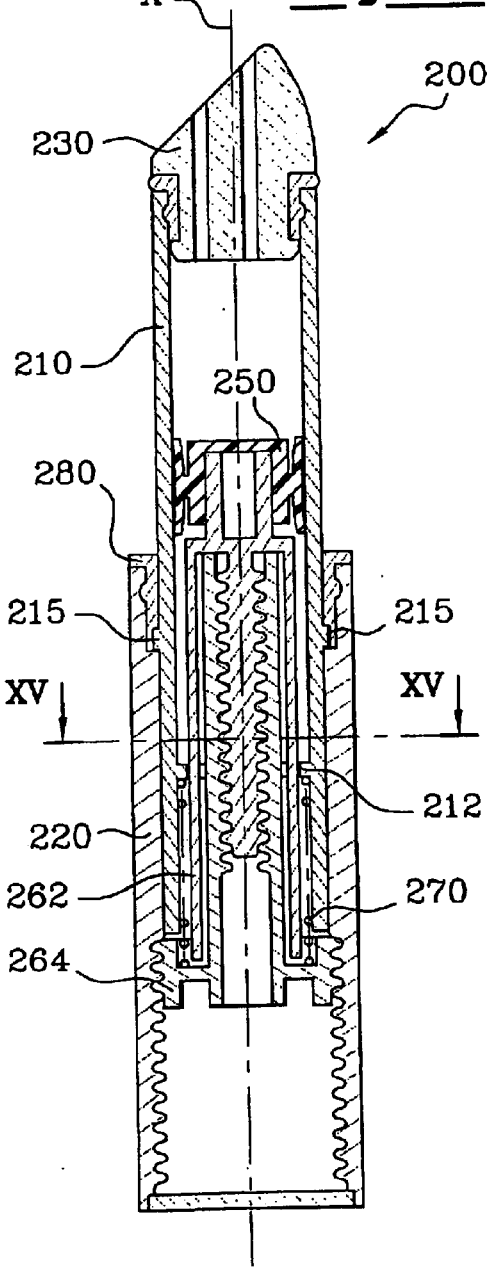
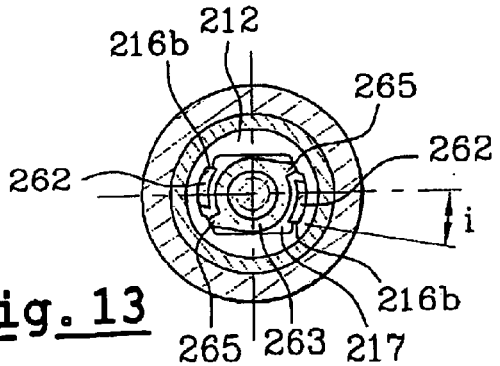
Fig. 13
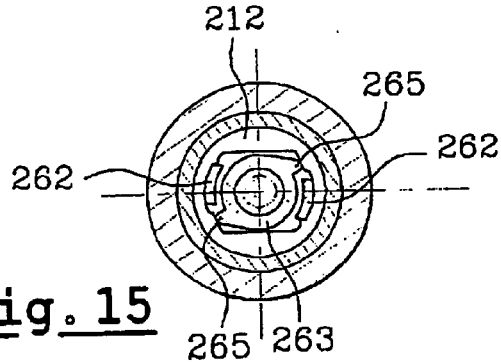
Fig. 15

DEVICE FOR PACKAGING AND DISTRIBUTING A SUBSTANCE

CROSS-REFERENCE TO RELATED APPLICATIONS

This document claims priority to French Application No. 0108804 filed Jul. 3, 2001, the entire content of which is hereby incorporated by reference.

BACKGROUND OF THE INVENTION

Field of the Invention

The present invention relates to devices for packaging and dispensing a substance. More particularly, the present invention relates to devices for packaging and distributing cosmetic products, including but not limited to, a liquid lipstick.

DESCRIPTION OF THE BACKGROUND

Devices for packaging and distributing liquid lipstick are known. These devices include a housing to contain the substance and a movable piston in the housing to expel the substance. The devices can also include a piston-driving mechanism having a first element that is turnable relative to a second element to cause axial displacement of the piston in the housing.

These conventional devices, however, have drawbacks. For example, when the substance is a liquid, a leak can occur under excessive pressure in the housing. For example, excessive pressure can occur due to a rise in temperature.

SUMMARY OF THE INVENTION

Consequently, there is a need for an improved packaging and distribution device. For instance, there is a need for a device that can reduce the risks of liquid leakage. There is a further need for such a device to be of relatively simple construction, to be inexpensive to produce, aesthetically pleasing, and to function reliably. An object of the present invention is to provide such a device.

The present invention accomplishes these objects and others by providing a novel device for packaging and distributing a substance. The device includes a housing for the substance, a piston movable in the housing to expel the substance, and a piston-driving mechanism including a first element (e.g., a sleeve) turnable relative to a second element (e.g., a body for the device) to cause axial displacement of the piston in the housing. This axial displacement is caused at least once one of the elements has turned a certain amount relative to the other. The device includes a ring for transforming relative rotation of the two elements over a first angular path in a substance-dispensing direction into relative axial displacement of the two elements. The ring is arranged to turn with the first element (e.g., the sleeve) over the first angular path and to co-operate with the second element (e.g., the body) to cause the axial displacement. The ring is also arranged to turn, when the relative rotation of the two elements is continued beyond the first angular path, relative to the first element by being driven in rotation by the second element.

During storage, the two above-mentioned elements can displace axially under the excess pressure inside the housing containing the substance. This axial movement causes the volume of the housing containing the substance to increase, and reduces or eliminates the excess pressure. The device thus reduces the risks of liquid leakage when the substance is liquid.

In a preferred embodiment, the ring is mounted on the first element, for example, by snap fastening. The ring can rotate relative to the first element if a sufficient driving force is exerted on the ring. In particular, the top portion of the first element can have a mounting skirt and the ring can be snap fastened into the mounting skirt. Such an arrangement allows the ring to turn relative to the mounting skirt if a sufficient torque is exerted.

In another preferred embodiment, the device includes a mechanism for automatically producing a relative movement of the two elements, accompanied by an increase in the volume of the housing, when one of the elements driven in displacement by the user in the substance dispensing direction is released and/or when a cap is placed on the device and/or in the event of excess pressure inside the housing. For example, the device can include a spring for producing the automatic return movement. In a particular embodiment, the spring can work in compression, i.e., the spring is in a compressed state.

In another preferred embodiment, the first element has a first bearing surface and the device includes a cap which has a second bearing surface configured to co-operate with the first bearing surface so that, when placing the cap on the device, the first element is displaced relative to the second element. For example, this arrangement can be configured to move the first element relative to the second element in the absence of the spring or if for any reason the spring has not exerted sufficient force to cause the displacement in question.

In a preferred embodiment, the first element can include a sleeve and the second element can include the body of the device on which the sleeve is mounted. The body and the piston to define the housing containing the substance. The ring can be coupled to the sleeve.

In a particular embodiment, the body includes at least one pin and the ring includes at least one ramp against which the pin can bear, so that rotation of the ring relative to the pin is accompanied by axial displacement of the ring relative to the body. Alternatively, the body can have at least one ramp and the ring can have at least one pin.

The sleeve can be axially positioned between a body base and the top portion of the body. The piston can be integral with a support co-operating with the sleeve by a rotational or a screwing action. One of the elements can turn relative to the other over a limited angular path without activating the dispensing mechanism. In particular, the support can turn freely relative to the body over a limited angular path relative thereto. This angular path is preferably less than 90°, more preferably less than 45°, and even more preferably between 5° and 25° or between 5° and 20°. In two preferred embodiments, the range is about 10° and about 15°.

The body can include at least one longitudinal opening and the support can include at least one extension engaged in the opening. The distance between the two longitudinal edges of the body opening can be greater than the width of the extension, so that the support is free to turn through a limited angular path relative to the body. The lateral extension can include a threaded portion co-operating with a thread on the sleeve, so that rotation of the sleeve relative to the support is accompanied by axial displacement of the support relative to the sleeve. The support can act as a bearing for the end of a spring. The spring can be biased by the axial displacement of the sleeve relative to the body while dispensing the substance. The support can include a bottom portion at least partially engaged through an opening in the base of the body.

The sleeve can also be situated at the bottom portion of the device. In this case, the piston can be integral with a part co-operating with an intermediate part, itself co-operating with the sleeve. The support can include at least one longitudinal finger engaged in an opening in the body, so as to be capable of turning through a limited angular path relative to the body. The finger can have two longitudinal edges spaced apart by a distance that differs from the spacing of two portions in relief on the body. The intermediate part can include at least one portion in relief co-operating with the body so as to be capable of turning through a limited angular path. The device can include a compression spring, one end of which bears on the intermediate part and the other end of which bears on a wall of the body. In general, the device can include an applicator tip when the substance is a liquid. When the relative movement of the two elements occurs automatically under excess pressure, the section of the channels in the applicator tip can be selected so that the two elements are displaced before the substance can be dispensed via those channels. In other words, the force required to cause the two elements to move in the event of excess pressure is lower than that required to cause the substance to be dispensed.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIG. 1 is a diagrammatic axial section view of a preferred embodiment of the present invention;

FIG. 2 is a diagrammatic cross-section view that illustrates an angular displacement of the support relative to the device body;

FIG. 3 is an analogous view to FIG. 1, after axial displacement of the sleeve relative to the support;

FIG. 4 is an analogous view to FIG. 2 after rotation of the support relative to the body;

FIG. 7 is a diagrammatic side elevation view of another preferred embodiment of the present invention;

FIG. 8 is a diagrammatic axial section view of the device of FIG. 7;

FIG. 9 is a section view across the line IX—IX of FIG. 8;

FIG. 10 shows a portion of the piston-lifting mechanism in isolation;

FIG. 11 is a top view along arrow XI of FIG. 10;

FIG. 12 is an analogous view to FIG. 8 during dispensing of the substance;

FIG. 13 is a section view across the line XIII—XIII of FIG. 12;

FIG. 14 is an analogous view to FIG. 8, the piston-raising movement being continued compared with the configuration of FIG. 12;

FIG. 15 is a section view across the line XV of FIG. 14;

DETAILED DESCRIPTION OF THE PREFERRED EMBODIMENTS

Figure 5:
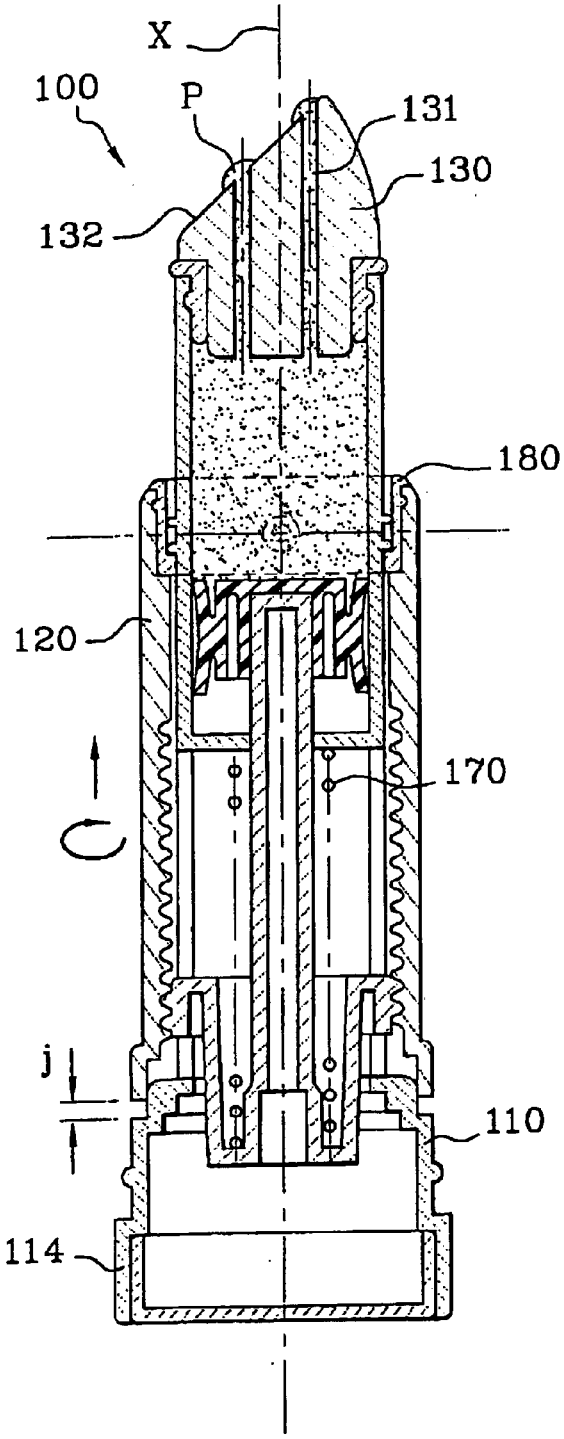
FIG. 5 is an analogous view to FIG. 1, illustrating dispensing of the substance.

FIGS. 1 to 6 show a device 100 including a body 110 and a sleeve 120 that can turn relative to the body. The top portion of the body is provided with an applicator tip 130. For example, the applicator tip 130 can be formed from an elastomer, which can be flocked. The applicator tip 130 can have channels 131 passing through it for supplying the substance. In the example shown, tip 130 has an applicator surface 132 that extends along a plane that is oblique relative to axis X of body 110. Other applicator geometries are within the scope of the present invention. The top portion 111 of body 110 defines a housing 140 for receiving a reserve of a substance P. The substance P can be, for example, a liquid lipstick or another cosmetic product.

The housing 140 can have an internal cylindrical surface and a surface of revolution about the axis X in this example. The device 100 has a piston 150 movable in the housing 140. This piston 150 can move to create excess pressure to expel a certain quantity of the substance P through channels 131 onto the applicator surface 132.

The piston 150 can be integral with a support 160. The support 160 can include a shaft 161 with its top end coupled or fixed to the piston and with its bottom end connected to a skirt 162. The shaft 161 can be hollow. The skirt 162 can be provided with two externally threaded and diametrically opposed lateral extensions 163.

The shaft 161 and the skirt 162 together form a groove 164 housing the bottom end of a spring 170. The top end of the spring bears against a transverse wall 112 of body 110. The transverse wall 112 has a central opening for passing the support shaft 160. The skirt 162 passes through an opening 113 in the base 114 of device 100.

A ring 180 is coupled to the sleeve 120. For example, the ring 180 can be snap fastened into a mounting skirt 121 on the top end of the sleeve 120. The ring 180 can include an annular flange 181 coupled to the mounting skirt 121. For example, the annular flange 181 can be snap fastened into a corresponding groove 122 in the mounting skirt 121. The internal radial surface of the ring 180 can have at least one helical groove 183 defining a ramp, shown in FIG. 1 in dotted lines. The top portion 111 of body 110 can have at least one corresponding pin 115 engaged in the groove. The diameter of the pin 115 can substantially correspond to the width of the groove 183. The device can include two diametrically opposed pins 115, and the ring 180 can include two corresponding grooves 183.

The present invention is not intended to be limited to this pin-on-body or groove-on-ring configuration. Alternate coupling mechanisms between the ring 180 and the body 110 are within the scope of the invention. For example, the body can define a groove and the ring can include a pin, or other protrusion, engaged in the groove. In a preferred embodiment, the coupling mechanism causes axial displacement of the body relative to the sleeve for rotations over a limited angular range. The coupling mechanism can rotate relative to one of the body or the sleeve over a limited angular range and can rotate relative to the other beyond the angular range.

Between the transverse wall 112 and the wall defining the opening 113, the body 110 has two longitudinal openings 116 in which the lateral extensions 163 of support 160 are engaged, as can be seen in FIG. 2. Each opening 116 is defined by two longitudinal edges 116*a* and 116*b* spaced apart by more than the width of one extension 163, to allow a certain angular displacement stroke for the support 160 in the body 110. This angular displacement stroke can be, for example, through a limited angular range. This angular range is preferably less than 90°, and more preferably less than 45°, for example, between 5° and 25°. In the illustrated example, the angular range is i, about 15°.

Figure 6:
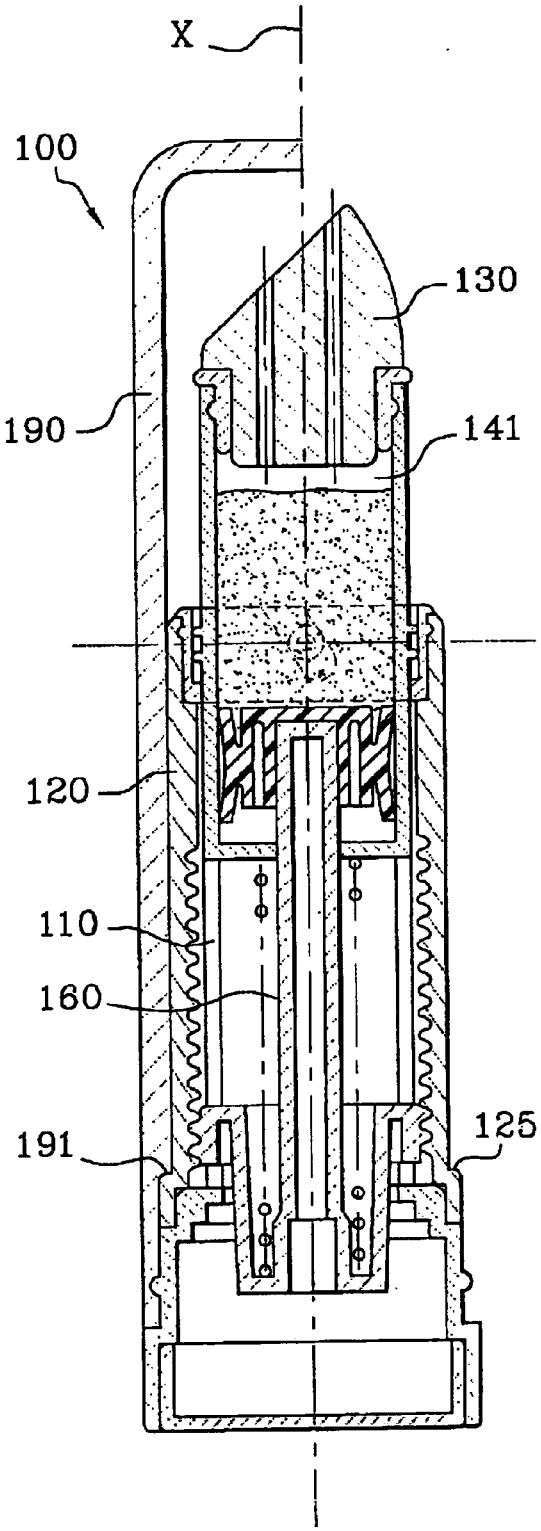
FIG. 6 is an analogous view to FIG. 1, showing the device after putting on the closing cap.

The base 114 of body 110 can have a bead 117 allowing snap fastening of a cap 190, as can be seen in FIG. 6. Other coupling mechanisms between the cap 190 and the body 110 are within the scope of the present invention. The cap 190 can have a shoulder 191 configured to bear against a shoulder 125 on the sleeve, as is described below. The base 114 is closed by an attached end wall 119.

The device 110 can function as follows. Assume that the housing 140 is full of substance P and that the cap 190 has just been removed, as shown in FIG. 1. The user starts to turn sleeve 120 relative to the body 110 over a first angular path through an angle i as defined above, in the direction of arrow A. The direction of arrow A is also referred to as the "substance-dispensing" direction. During the first angular path, the support 160 turns with the sleeve 120 and the lateral extensions 163 of the support 160 change from bearing on the longitudinal edges 116*a* to bearing on the opposed longitudinal edges 116*b*. The spring 170 is initially compressed only slightly.

Co-operation between the ring 180 and the body 110 means that rotation of sleeve 120 is accompanied by axial upward displacement thereof relative to the base 114, the ring 180 turning with the sleeve 120 and the pin 115 being displaced in the helical groove 183. The assembly constituted by the sleeve 120, the ring 180, the support 160 and the piston 150 is then axially displaced by the same distance i. This axial distance can be of the order of 2 millimeters (mm) in the example described. The space 141 above the level of the liquid in the housing 140 fills with liquid as the piston 150 rises in the housing 140, as can be seen in FIG. 3. Upward displacement of the sleeve 120 is accompanied by a small amount of compression of the spring 170 since the support 160 has followed the upward movement of the sleeve 120.

When rotation of the sleeve 120 relative to the body 110 is continued in the substance-dispensing direction, i.e., in the direction of arrow A, the support 160 is prevented from turning relative to the body 110 because the lateral extensions 163 come to bear against the longitudinal edges 116*b*, as shown in FIG. 4. The sleeve 120 then turns relative to the support 160, and because of the co-operating screw threads of the support 160 and the sleeve 120, this causes an upward displacement of the support 160, the sleeve 120 then being prevented from moving further upwards by the pin 115 of the body 110.

The upward movement of the support 160, and thus of the piston 150, is accompanied by the substance being dispensed via the channels 131 onto the applicator surface 132, as shown in FIG. 5. When the user releases the sleeve 120, the spring 170 tends to return the sleeve 120 downwards until it bears against the base 114. The ring 180 causes the collar 120 to rotate in the direction of arrow B in FIG. 2. The support 160 turns with the collar 120 in the longitudinal openings 116 and descends, causing the piston 150 to retract inside the reservoir and generating suction which ensures at least partial evacuation of the substance present in the channels 131, and again forming an open space 141 above the substance in the housing 140.

In accordance with the invention, the arrangement can be provided without spring 170. For example, the collar 120 can be caused to return towards the base 114 by putting on the cap 190 and pushing the shoulder 191 against the step 125, as shown in FIG. 6. In the absence of the spring 170 and of the cap 190, and in the event of excess pressure in the housing 140 containing the substance, the piston 150 can also retract from the configuration of FIG. 5 until the collar 120 comes into axial abutment against the base 114 of the body 110.

Reference is now made to FIGS. 7 to 19 to describe a device 200 according to another embodiment of the present invention. The device 200 includes a body 210 with an axis X and a sleeve 220 that can turn relative to the body 210 about the axis X. The top part of body 210 is provided with a tip 230 similar to the tip 130 described above, and defines a housing 240 with an internal cylindrical surface. A piston 250 can slide within the housing 240. The piston 250 can be integral with a mechanism 260 including two parts 260*a*, 260*b*. The first part 260*a* includes a screw 261 with its top end fixed to the piston 250 and two longitudinal fingers 262, which can be formed integrally with the screw 261. The fingers 262 can be diametrically opposed. The other part 260*b* includes an internally threaded hollow shaft 263 in which the screw 261 is engaged, and a collar 264 at its bottom end. The collar is connected to the shaft 263 via a wall 266 on which a spring 270 bears. The collar 264 is externally threaded and co-operates with an internal screw thread 229 on the sleeve 220 by a rotational or a screwing action.

FIGS. 10 and 11 show the part 260*b* of the mechanism 260 in isolation. Part of the shaft 263 can be seen to be externally provided with two anti-rotation ribs 265, the function of which is described below. The two anti-rotation ribs 265 can be substantially diametrically opposed. The ribs 265 can extend over only substantially half the height of the shaft 263, from its top end. Only one of the ribs 265 can be seen in FIG. 10.

The spring 270 can work in compression. Its bottom end can bear on the wall 266 and its other end can bear against a transverse wall 212 having an opening 217 through which the mechanism 260 passes.

A ring 280 is snap fastened into a mounting skirt 221 located on the top portion of sleeve 220. In similar manner to the ring 180 described above, the ring 280 can have a bead 281 snap fastened into an annular groove 222 of the mounting skirt 221. In this illustrated embodiment, the ring 280 has two diametrically opposed helical grooves 283 in each of which a pin 215 of the body 210 is engaged. The bottom portion of the sleeve 220 is closed by an attached end wall 229.

An examination of FIG. 9 shows that the wall 212 has recesses 216 in which the fingers 262 are engaged. The longitudinal edges 216*a* and 216*b* of these recesses are spaced apart by a distance that is greater than the width of the fingers 262. This feature allows the mechanism 260 to move through a certain angular range relative to the body 210. The opening 217 in the transverse wall 212 can also be shaped to allow the anti-rotation ribs 265 to move angularly through an angle of the same amplitude.

The device 200 includes a cap 290, which can be seen in FIG. 8. The device 200 can function as follows. After removing the cap 290, the user turns the sleeve 220 relative to body 210 over a first angular path i. The ring 280 does not move relative to the sleeve 220, so relative movement between the body 210 and the sleeve 220 is accompanied by upward displacement of the sleeve relative to the body 210, as shown in FIG. 14. In the example described, relative movement along the first angular path causes the fingers 262 to come into contact with the edges 216*b* of the recesses 216, as shown in FIG. 13, and one abutment of each of the anti-rotation rib 265 abuts against an edge of the opening 217 in transverse wall 212. The sleeve 220 is displaced upwardly with the mechanism 260 and the piston 250. The pins 215 then abut against the sleeve 220, as can be seen in FIG. 12.

Figure 16:
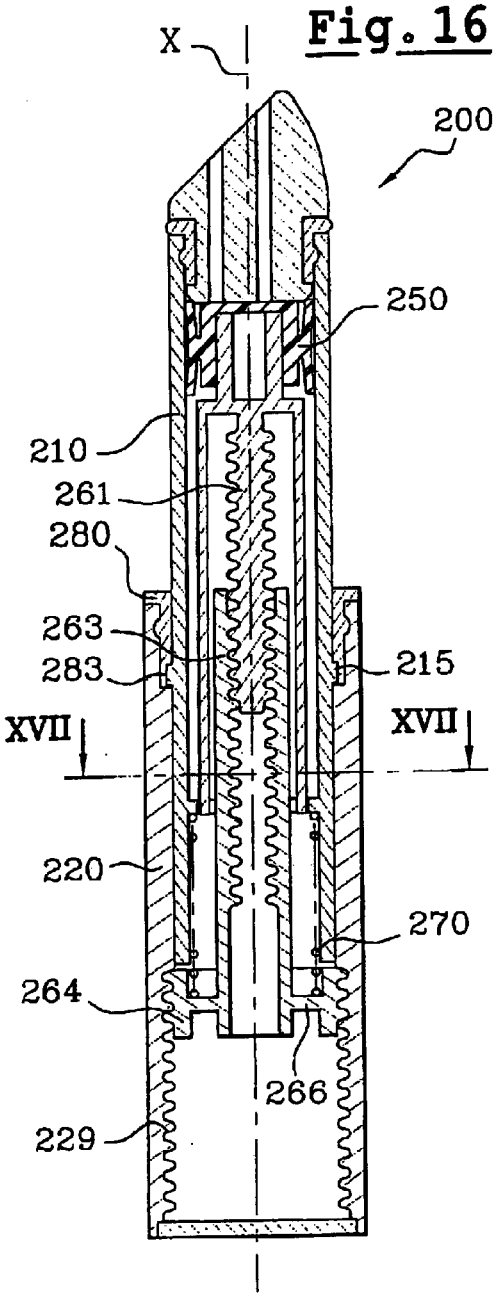
FIG. 16 is a diagrammatic axial section view showing the device at the end of the upward stroke of the piston.
Figure 18:
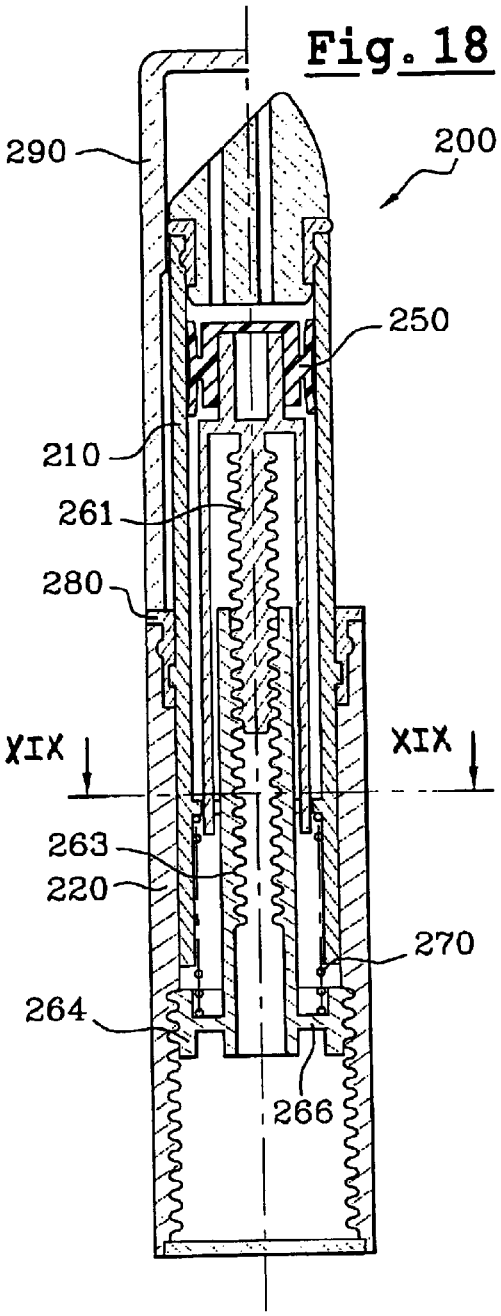
FIG. 18 shows the device after putting on the cap.
Figure 17:
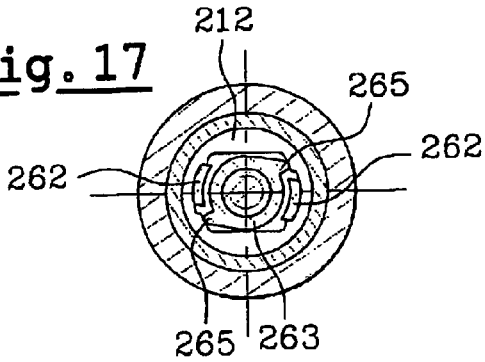
FIG. 17 is a section view across the line XVII—XVII of FIG. 16.

As shown in FIG. 14, continuing rotation in the substance-dispensing direction causes the collar 264 to be displaced upwardly in the screw thread 229 of the sleeve, then secondly, causes the screw 261 to unscrew out of the hollow shaft 263, as shown in FIG. 16. The spring 270 is compressed.

Figure 19:
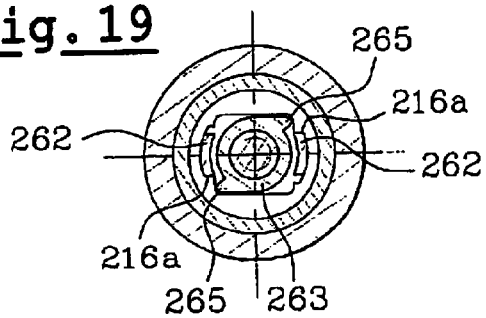
FIG. 19 is a section view across the line XIX—XIX of FIG. 18.

During the rotational movements of the collar 264 in the sleeve 220 and of the shaft of the screw 261 in the hollow shaft 263, the ring 280 can turn relative to the sleeve 220. When the user releases the sleeve 220 or the body 210, the spring 270 tends to return the sleeve 220 downwards and it can descend while turning. The pins 215 travel along the annular groove 283 until the fingers 262 abut against the edges 216*a* of the recesses 216, as shown in FIG. 19. The descending movement of the sleeve is accompanied by a corresponding movement of the mechanism 260, and thus the piston 250 retracts inside the housing 240.

Obviously, numerous modifications and variations of the present invention are possible in light of the above teachings. It is therefore to be understood that within the scope of the appended claims, the invention can be practiced otherwise than as specifically described therein.

What is claimed as new and desired to be secured by Letters Patent of the United States is:

1. A device for packaging and distributing a substance, comprising:

a housing for the substance;

a piston movable in said housing;

a piston-driving mechanism comprising a first element turnable relative to a second element to cause axial displacement of the piston in the housing, after at least one of the elements has turned an amount relative to the other;

a ring for transforming relative rotation of said first and second elements over a first angular path in a substance-dispensing direction into relative axial displacement of the first and second elements, said ring being arranged to turn firstly with the first element over said first angular path and to co-operate with the second element to cause said axial displacement and secondly, when relative rotation of the first and second elements is continued beyond the first angular path, to turn relative to the first element by being driven in rotation by the second element.

2. A device according to claim 1, wherein the ring is mounted on the first element so as to rotate relative to the first element if a sufficient driving force is exerted.

3. A device according to claim 1, wherein a top portion of the first element has a mounting skirt and wherein the ring is snap fastened into the mounting skirt, said ring being capable of turning relative to the mounting skirt if sufficient torque is exerted.

4. A device according to claim 1, including means for automatically producing relative movement of the first and second elements, accompanied by an increase in the volume of the housing.

5. A device according to claim 4, wherein said means produces an automatic relative movement when one of said first and second elements driven in displacement by the user in the substance-dispensing direction is released.

6. A device according to claim 4, wherein said means produces said automatic relative movement when a cap is placed on the device.

7. A device according to claim 4, wherein said means produces said automatic relative movement in the event of excess pressure inside the housing.

8. A device according to claim 1, further comprising a spring coupled to said first and second elements.

9. A device according to claim 8, wherein the spring is in a compressed state.

10. A device according to claim 1, wherein the first element has a first bearing surface; and wherein the device further comprises a cap with a second bearing surface which co-operates with the first bearing surface so that, when placing the cap on the device, the first element is displaced relative to the second element.

11. A device according to claim 1, wherein the first element comprises a sleeve and the second element comprises a body of the device on which the sleeve is mounted, the body co-operating with the piston to define the housing containing the substance.

12. A device according to claim 11, wherein the ring is mounted on the sleeve.

13. A device according to claim 11, wherein one of the body and the ring includes at least one pin and the other one includes at least one ramp on which the pin can bear, so that rotation of the ring relative to the body is accompanied by an axial displacement of the ring relative to the body.

14. A device according to claim 11, wherein the sleeve is axially positioned between a body base and the top portion of the body.

15. A device according to claim 11, wherein the piston is integral with a support coupled to the sleeve via a screwing arrangement.

16. A device according to claim 15, wherein the support is free to turn relative to the body over a limited angular path relative thereto.

17. A device according to claim 16, wherein said limited angular path is in the range 5° to 25°.

18. A device according to claim 15, wherein the body has at least one longitudinal opening and the support has at least one extension engaged in the opening, the distance between two longitudinal edges of the body opening being greater than the width of the extension.

19. A device according to claim 18, wherein the extension has a threaded portion co-operating with a screw thread on the sleeve, so that rotation of the sleeve relative to the support is accompanied by an axial displacement of the support relative to the sleeve.

20. A device according to claim 15, further comprising a spring, one end of said spring bearing on the support, the spring being biased by the axial displacement of the sleeve relative to the body when dispensing the substance.

21. A device according to claim 15, wherein the support includes a bottom portion at least partially engaged through an opening in a base of the body.

22. A device according to claim 1, wherein the first element comprises a sleeve located in a bottom portion of the device.

23. A device according to claim 22, wherein the piston is integral with a part co-operating with an intermediate part co-operating with the sleeve.

24. A device according to claim 22, wherein the piston is coupled to a support having at least one longitudinal finger engaged in an opening in the body, so that said support is configured to turn along a limited angular path relative to the body.

25. A device according to claim 24, wherein the finger has two longitudinal edges spaced apart by a distance that differs from the distance between two portions in relief of the body.

26. A device according to claim 23, wherein the intermediate part includes at least one portion in relief co-operating with the body so as to be turnable through a limited angular stroke.

27. A device according to claim 23, further comprising a spring which is in a compressed state, one end of said spring bearing on the intermediate part and the other end of said spring bearing on a wall of the body.

28. A device according to claim 1, further comprising an applicator tip coupled to said housing.

29. A device according to claim 28, wherein said substance is a liquid.

30. A device according to claim 28, wherein said substance is a cosmetic product.

31. A device for dispensing a product, comprising:

a body;

a sleeve movable relative to said body;

a piston movable within said body and comprising a shaft coupled to said sleeve;

a first coupling member between said shaft and said sleeve, said first coupling member having at least one extension engaged in an opening of said body, wherein said extension is movable within said opening relative to said body over an angular range; and a second coupling member between said body and said sleeve, said second coupling member being rotatable relative to said body over said angular range and rotatable relative to said sleeve beyond said angular range.

32. A device according to claim 31, wherein said first coupling member comprises a skirt connected to a bottom portion of said shaft.

33. A device according to claim 32, wherein said extension has external threads so as to couple said skirt with said sleeve via said external threads.

34. A device according to claim 31, wherein said second coupling member comprises a ring.

35. A device according to claim 34, wherein said ring is snap fastened to said sleeve.

36. A device according to claim 34, wherein said sleeve comprises a skirt and said ring is snap fastened to said skirt.

37. A device according to claim 36, wherein said ring defines a groove.

38. A device according to claim 37, wherein said body comprises a protrusion engaged in said groove.

39. A device according to claim 38, wherein said protrusion is movable within said groove over said angular range.

40. A device according to claim 31, further comprising a spring between said first coupling member and said second coupling member.

41. A device according to claim 31, wherein said angular range is less than 45°.

42. A device according to claim 31, wherein said angular range is between 5° and 25°.

43. A device according to claim 31, wherein said angular range is about 15°.

44. A device according to claim 31, further comprising an applicator defining a channel accessible to said product within said body.

45. A device according to claim 31, wherein the sleeve has first bearing surface; and wherein the device further comprises a cap with a second bearing surface which co-operates with the first bearing surface so that, when placing the cap on the device, the sleeve is displaced relative to the body.

46. A device for dispensing a product, comprising:

a body;

a sleeve movable relative to said body;

a piston movable within said body; and a piston driving mechanism comprising a first part and a second part, wherein:

the first part comprises a screw having an end coupled to said piston and at least one longitudinal finger having an end coupled to said piston, the second part comprises an internally threaded hollow shaft, said screw being engaged in said internally threaded hollow shaft, the second part further comprising a collar coupled to said sleeve, and said longitudinal finger passes through an opening of a transverse wall of said body, said longitudinal finger being movable within said opening over an angular range so that said first part is rotatable relative to said body over said angular range.

47. A device according to claim 46, wherein said first part comprises two diametrically opposed longitudinal fingers.

48. A device according to claim 46, wherein said collar has external threads so as to couple said second part to said sleeve via said threads.

49. A device according to claim 46, wherein said hollow shaft includes external ribs.

50. A device according to claim 46, further comprising a ring between said body and said sleeve.

51. A device according to claim 50, wherein said ring is snap fastened to said sleeve.

52. A device according to claim 51, wherein said sleeve comprises a skirt and said ring is snap fastened to said skirt.

53. A device according to claim 50, wherein said ring defines a groove.

54. A device according to claim 53, wherein said body comprises a protrusion engaged in said groove.

55. A device according to claim 54, wherein said protrusion is movable within said groove when said ring rotates relative to said body over said angular range.

56. A device according to claim 46, further comprising a spring between said transverse wall and said collar.

57. A device according to claim 46, wherein said angular range is less than 45°.

58. A device according to claim 57, wherein said angular range is between 5° and 25°.

59. A device according to claim 58, wherein said angular range is about 15°.

60. A device according to claim 46, further comprising an applicator defining a channel accessible to said product within said body.

61. A device according to claim 46, further comprising a cap which co-operates with the body.

* * * * *